United States Patent [19]

Gelfand

[11] 4,196,960

[45] Apr. 8, 1980

[54] CABLE LUG AND METHOD OF MAKING SAME

[75] Inventor: Leonard Gelfand, Chagrin Falls, Ohio

[73] Assignee: Erico Products, Inc., Cleveland, Ohio

[21] Appl. No.: 740,420

[22] Filed: Nov. 10, 1976

[51] Int. Cl.[2] ..... H01R 11/06

[52] U.S. Cl. ..... 339/275 T

[58] Field of Search ..... 339/275, 276 RB; 113/116 W

[56] References Cited

U.S. PATENT DOCUMENTS

| | | | |
|---|---|---|---|
| 988,208 | 3/1911 | Porter | 254/131 |
| 1,112,047 | 9/1914 | Ziegler | 339/275 R |
| 1,267,152 | 5/1918 | Whitaker | 81/3.46 R |
| 1,977,846 | 10/1934 | Febrey | 339/275 R |
| 2,794,176 | 5/1957 | Barnes | 339/275 T |
| 2,799,840 | 7/1957 | Barnes | 339/275 T |
| 2,927,230 | 3/1960 | Guarnier | 339/275 R |
| 3,949,466 | 4/1976 | O'Brien et al. | 339/275 T |

*Primary Examiner*—Joseph H. McGlynn

*Attorney, Agent, or Firm*—Maky, Renner, Otto & Boisselle

[57] ABSTRACT

A cable lug of the offset bar type for flush mounting on flat contact surfaces including a flat lug having a cropped and sharply upturned end abutting the end of the offset cable, and a cast weld sleeve surrounding the upturned end and the adjacent end portion of the cable securing them together, and a method for making the same.

7 Claims, 9 Drawing Figures

CABLE LUG AND METHOD OF MAKING SAME

BACKGROUND OF THE INVENTION

The present invention pertains to cable lugs and cable lug assemblies of the type used for mounting conductors to contact surfaces, and more particularly to flush mounting cable lug assemblies for connecting cables to flat contact surfaces, and a method for making the same.

Those cable lug assemblies presently used generally consist of a relatively flat lug plate with a cable secured to the edge thereof by welding. In straight bar lugs, the cable abuts the lug edge such that part of the cable extends above and below the bar, and the weld sleeving encasing the lug and cable extends even further giving the assembly a bulky profile so that the lug cannot be used for securing the cable to a flat contact surface because of interference between the weld sleeving and the bolting surface. Insulation around the weld sleeve further accentuates the problem.

To alleviate this problem, offset lugs have been used wherein the lug is shaped to include an offset portion at the cable end to elevate the cable and weld sleeving from the bolting surface or pad. However, such lugs still utilize the conventional type of weld wherein the cable abuts the lug along the edge thereof. Conventional offset lugs require a large amount of copper to form the lug, and a large amount of weld metal to form the sleeve. Moreover, when using an exothermic process which includes a mold to form the connection, the lug and cable are difficult properly to locate and position in the mold.

SUMMARY OF THE INVENTION

The present invention includes a flat lug having one end thereof cropped and bent sharply upwardly to form an end face or edge along its upturned underside which abuts the end of a cable, the axis of which is generally parallel to but offset from the major flat portion of the lug. The top edge of the bent-up end extends to approximately the center of the cable and is high enough so that the entire cable lies well above the plane of the bottom contact surface of the lug to provide the cable lug with an offset flat bolting face. The weld sleeving encases the entire cropped and formed coupling end of the lug and the adjacent end of the cable to form a strong welded bond. As a consequence of the configuration of the lug and the interposition of the lug and cable, less weld metal is needed than in conventional lug assemblies to form the weld sleeve, and yet, forms an equally strong or stronger lug assembly.

The precise form of the upturned end is determined by the relative thickness and size of the lug. The relationship is such that a thinner lug permits a sharper, more precise bend. Regardless of the thickness of the lug and the manner in which the bend is formed, the same benefits in welding, cable location and ease of location of the lug in the mold when forming the cable lug assembly are obtained.

The method for making the cable lug assembly includes first forming the lug and then properly positioning the bent portion of the lug in a mold against a locating stop, abutting the cable against the end face of the bent portion so that the cable is above the plane of the bolting face of the lug, and causing super-heated weld metal to flow into the mold encasing and flowing around the cropped and bent end portion of the lug and the adjacent portion of the cable.

With the foregoing in mind, it is a primary object of the invention to provide an offset cable lug having the cable welded to the side of an upturned end.

Another important object is to reduce the amount of copper required for the lug and the amount of weld metal required in forming the cable lug assembly.

Still another object is to provide a method for making such cable lug assembly in a quick, accurate and convenient manner.

These and other objects and advantages of the invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENTS

Figure 2:
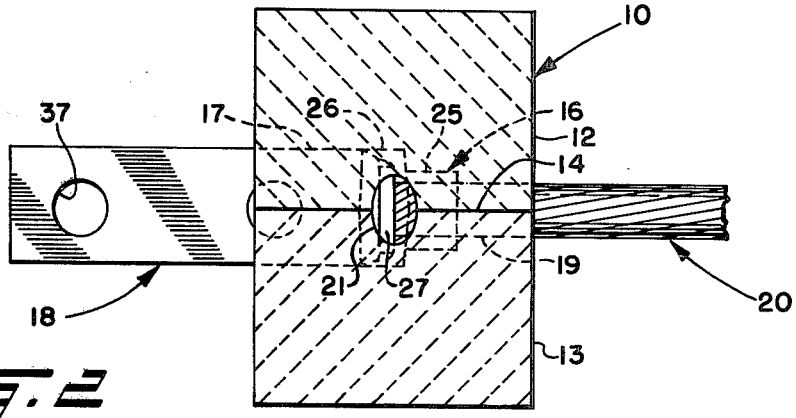
FIG. 2 is a horizontal section taken along the lines 2—2 of FIG. 1, showing the relative position of the lug and cable within the mold.
Figure 1:
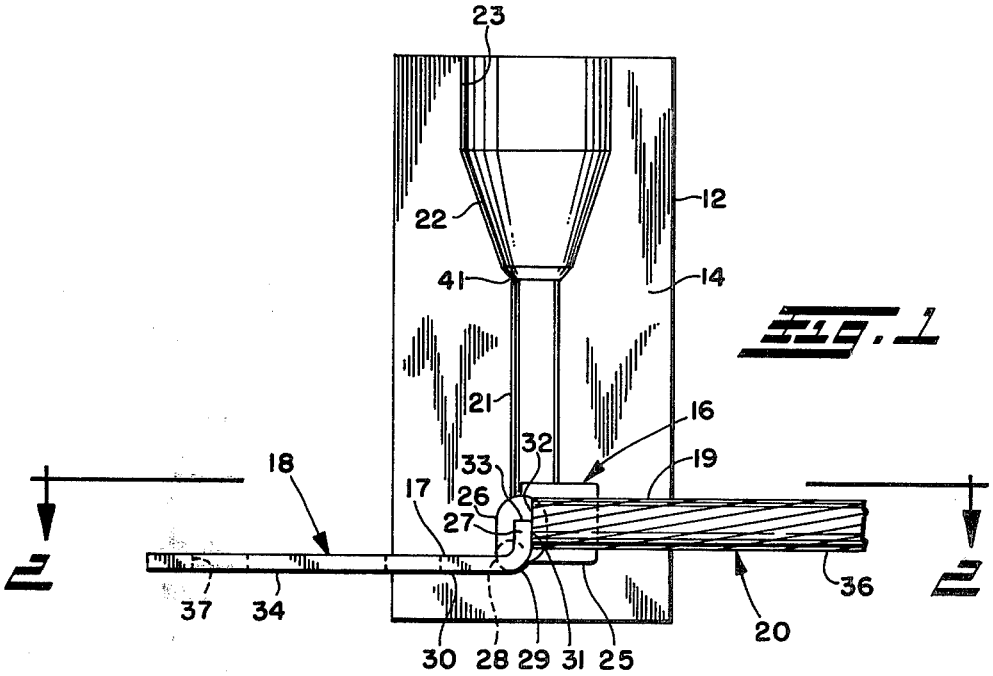
FIG. 1 is a side elevation of a mold for producing the cable lug assembly of the present invention with the near half removed showing the lug and cable positioned therein.

Referring now to the drawings and more particularly to FIGS. 1 and 2, a mold for producing a cable lug assembly in accordance with the present invention is generally designated at 10. The mold may comprise two mating halves 12 and 13, which, when assembled, are held together by a clamp, not shown. The mold halves, when held together, mate at the parting plane 14. Such mold halves may preferably be formed by a variety of machining steps from graphite blocks to form a plurality of slots, passages, and chambers therein as shown in FIG. 1. It will be appreciated that the slots, passages, and chambers formed in the mating faces of the graphite blocks forming the mold will be mirror images of each other. Accordingly, only the slots, passages and chambers formed in the mold half 12 will be described in detail.

Positioned centrally of the mold near the bottom is a generally T-shape weld chamber 16. Communicating with the weld chamber 16 is a horizontal lug slot 17 accommodating lug 18, a cable bore 19 accommodating cable 20, and a vertically extending tap hole 21 connecting the weld cavity with crucible chamber 22 which is open at the top of the mold as indicated at 23. The lug slot 17 and cable bore 19 are formed to accommodate the lug 18 and cable 20, respectively, with relatively close clearance so that weld metal will not flow out of the mold along the slot or bore around the lug or cable.

The weld cavity 16 is formed by two sections which extend normal to each other, the first, the stem of the T, being an enlarged cylindrical chamber 25 adapted to surround the cable end when positioned in the mold. The second portion 26 of the weld cavity, the head of the T, extends transversely of and slightly lower than the first portion and essentially completely surrounds the upturned end 27 of the lug.

The chamber 26 which intersects the chamber 25 to form the weld cavity 16 is slightly wider at its center than at its outer ends as seen in FIG. 2 and includes a lower offset portion 28 which may be formed by an end mill providing a radius or abutment surface indicated at 29 having essentially the same radius as the underside of the upturned end 27 of the lug 18. It is understood that the vertical extent of the abutment is at a minimum at the bottom of the cavity portion 25.

The radius or abutment 29, of course, forms a tangent to the bottom 30 of the slot 17. When the upturned end 27 of the lug 18 is against the stop 29, the end face 31 of such lug, which is a continuation of the bottom surface of the lug, is substantially in the middle of the tap hole passage 21. In such position, it will abut against the end face 32 of the cable 20, the point of contact being again substantially at the center of the tap hole 21.

The top edge 33 of the upturned end of the lug is at approximately the center of the cable 20 and substantially vertically offset from the bottom contact surface 34 of the lug.

The stop surface 29 provides a vertical offset between the underside 34 of the lug and the underside of the weld cavity portion 25. There is also significant vertical offset between the underside 34 of the lug and the underside 36 of the cable. This permits insulation to be wrapped around the cable and even the cylindrical portion of the weld sleeve formed by the cavity portion 25, without affecting the ability of the lug to be firmly clamped to an adjacent pad or surface. As indicated, the lug along its major flat portion may be provided with one or more bolting apertures as indicated at 37.

Figure 3:
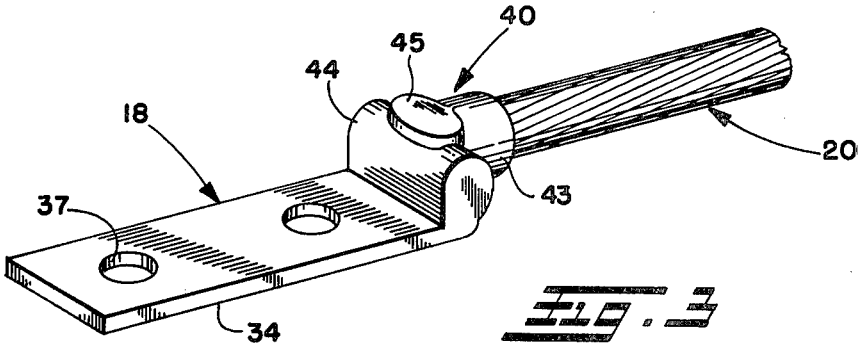
FIG. 3 is a perspective view of a preferred form of the cable lug assembly constructed in accordance with the present invention.

In order to form the weld sleeve indicated generally at 40 in FIG. 3, the lug and cable are introduced into the mold as indicated in FIG. 1, the two mold halves are then brought together as indicated in FIG. 2, and held by the noted clamp. When the lug is against the stop 29, both the lug end face 31 and the end face 32 of the cable will be in proper position beneath the tap hole 21 or riser. The cast metal necessary to form the weld sleeve may be obtained by the well-known CADWELD® process. Such process is an aluminothermic type welding process requiring no outside source of power or heat. In such process, a metal disc is positioned at the bottom of the crucible as indicated at 41 and the crucible is filled with an exothermic powder composition topped by a starting powder. A cover, not shown, is then placed over the crucible and the starting powder may be ignited with a flint gun, for example. The exothermic reaction occurs obtaining, for example, a reduction of copper oxide by aluminum producing a molten, super-heated copper which melts through the disc permitting the molten copper to run down the tap hole or passage 21 filling the weld cavity 16.

Although copper for the cable or conductor 20 as well as the lug 18 is preferred, it will be appreciated that other conductive metals may be employed which may also be welded by the afore-described process. Such materials as steel, copper clad steel, galvanized steel, stainless steel, wrought iron, cast iron, or aluminum may suitably be welded by the same process with differing powder compositions. In addition, the lug before assembly or the resultant lug assembly may be tinned if desired.

The major portion of the connection formed is a molecular weld and not a mechanical contact. As noted in FIG. 2, more evenly to distribute the super-heated molten metal, the tap hole or passage 21 is elliptical in cross sectional configuration. The super-heated metal of the process causes the components to be connected to be melted and fused into a solid homogenous mass. The connection is completed before the heat is dissipated by the conductors. The process applies a very high temperature for a short period, and the total heat input is generally quite a bit less than that involved in brazing or soldering the conductors. This is particularly important where protection of conductor insulation is a consideration.

As seen in FIG. 3, the portion 25 of the cavity 16 forms a sleeve 43 extending coaxially of the cable 20. The portion 26 of the cavity forms a transverse portion 44 integrally joined to the sleeve 43 which is the same width as the lug 18. A riser formed by excess metal in the tap hole 21 may be trimmed as indicated at 45.

When the molten metal has cooled sufficiently, the reusable graphite mold halves are separated and the lug assembly as seen in FIG. 3 is removed.

To facilitate separation of the mold halves 12, 13 from the lug assembly, the chamber 26 is preferably tapered being slightly wider at its center than at its outer ends as seen in FIG. 2. Molds of the type described are generally pivotally mounted with respect to each other and such slight taper allows the mold to disassociate from the weld sleeve 40 without damage to either as the mold halves 12, 13 swing apart.

Figure 4:
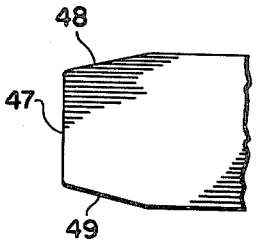
FIG. 4 is a fragmentary top plan view of a lug end showing the cropped tapered end prior to bending.
Figure 5:
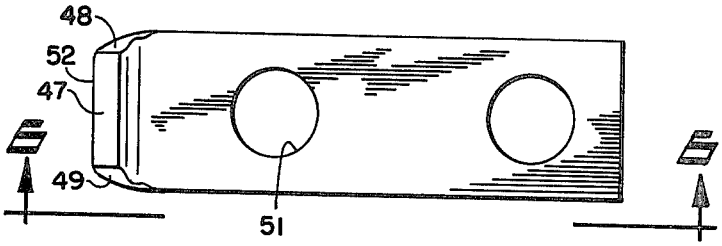
FIG. 5 is a top plan view of the lug subsequent to bending.
Figure 6:
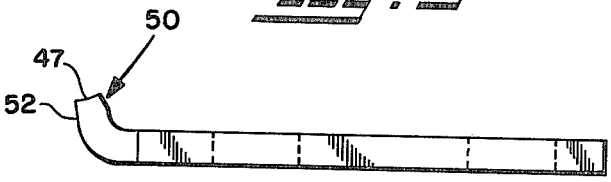
FIG. 6 is a side elevation of the lug shown in FIG. 5.

Referring now to FIGS. 4, 5 and 6, there is illustrated the formation of a lug in accordance with the present invention. The lug may be formed in a progressive two station die from half hard copper bar stock. For a one-hole lug, the material may have a cut length of approximately $1\frac{7}{8}''$ (47.63 mm). For a two-hole lug as illustrated in FIGS. 5 and 6, the material may have a cut length of approximately $3\frac{5}{8}''$ (92.06 mm). In the first station of the die, the bar is beveled or cropped at one end and cut. The cropping operation produces in addition to the end cut 47 a cropping or bevel cutting of the lateral edges of the bar as indicated at 48 and 49. Such cropping or bevel cutting may be at approximately 13° and reduces the width of the bar or lug at its upturned end. This permits the weld metal to flow completely around the bar. In this manner, less weld metal is used and there is avoided the deleterious effects of lug expansion during forming. Without the bevel cut, the expansion of the lug might tend to separate the mold halves or crack the same. In addition, such cropping or bevel cutting avoids a bulge which would be caused by bending of the lug, the bulge being wider than the width of the lug without the cropping.

The second station, by means of a compound die, bends the end upwardly as indicated at 50 and also places the fastening holes 51 therein. When the end of the lug is bent upwardly, the bottom surface of the lug adjacent the end face 47 is bent to form an end facing surface substantially abutting the end of the cable as indicated at 52.

The precise details of the angle of the bend and the configuration of the bend may vary depending upon the size and thickness of the lug as well as the forming tools employed.

Figure 7:
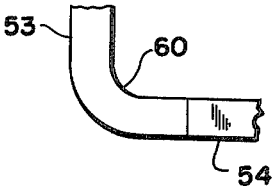
FIG. 7 is a fragmentary side elevation of a relatively thin lug depicting the bend.
Figure 8:
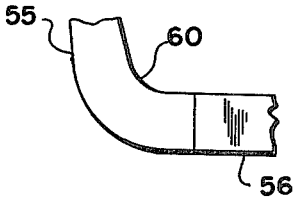
FIG. 8 is a similar view showing the bend for a lug having somewhat greater thickness.

For example, in FIG. 7, there is illustrated a lug having a thickness of approximately $\frac{1}{8}''$ (3.16 mm). With such relatively thin lug, a substantially 90° bend may be obtained so that the end face 53 of the lug is normal to the mounting face 54. In FIG. 8, the lug may be approximately 3/16" (4.76 mm) thick and accordingly the end face 55 may not be quite normal to the mounting face 56. In such situation, the end edge is somewhat wiped as indicated at 57 so that the end face 58 is curved and again not necessarily precisely normal to the mounting face 59.

Figure 9:
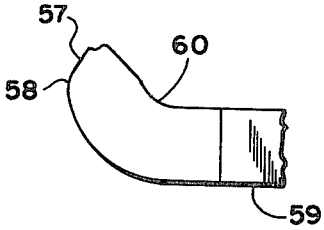
FIG. 9 is a similar view of the bent end of a lug which is relatively thick.

In each form of lug, the total height of the upturned end may be approximately 7/16" (11.11 mm) and the inner radius of the bend indicated at 60 formed by the same die. Such inner radius may be approximately $\frac{1}{8}''$ (3.16 mm). In the FIG. 7 embodiment, the end face 53 will abut flush against the end of the cable. In FIG. 8, the top edge 61 will abut against the cable end, and in FIG. 9, the furthest point on the radius 58 will abut against the cable end.

The radius of the end mill forming the bottom portion 28 of the cavity portion 26 in the mold may change depending upon the thickness of the lug employed. In any event, the point of contact between the lug and the end of the cable will be essentially in the middle of and beneath the tap hole or passage 21. In each case, the mold will provide a positive stop for the positioning of the lug in the mold in the weld cavity. It is also understood that movement out of such position away from the stop is limited by the upturned end 27. Thus, the lug is retained in a centered position, or relatively close thereto, between opposed stop surfaces of the weld cavity.

It will also be appreciated that the cable 20 may be a solid conductor such as a bus bar or wire. If the cable is comprised of fine strands, a sleeve may be positioned over such strands prior to welding.

It can now be seen that there is provided an offset cable lug having the cable welded to the side of an upturned end of the lug and which requires not only a reduced amount of metal for the lug, but also a reduced amount of weld metal. Moreover, with the present invention, the size of the mold required to form the assembly may be reduced and the components of the assembly may be quickly and easily positioned in the mold for weld joining.

I, therefore, particularly point out and distinctly claim as my invention:

1. A lug assembly comprising a flat bar of conductive metal, one end of said bar including at least one hole adapted to fasten a flat underside thereof to a mounting pad, and the other end of said lug being sharply bent away from said flat underside to form a short upturned end, the upturned underside of said upturned end presenting a weld connection face contiguous with the end face of a conductor generally parallel to but offset from said flat underside, and a cast weld sleeve surrounding said upturned end and adjacent end of said conductor.

2. A lug assembly as set forth in claim 1 wherein said bar at said upturned end is tapered to narrow the width of said bar to the approximate width of said conductor.

3. A lug assembly as set forth in claim 2 wherein that portion of said weld sleeve surrounding said weld sleeve surrounding said adjacent end of said conductor is slightly vertically offset from said flat underside of said bar.

4. A lug assembly as set forth in claim 2 wherein said cast weld sleeve is formed from super-heated molten metal to form a molecular weld between said bar and conductor.

5. A lug assembly as set forth in claim 2 wherein such taper extends through such sharply bent portion of said upturned end so that the width of such sharply bent portion is at the most the width of said one end of said bar.

6. A lug assembly as set forth in claim 2 wherein that portion of said weld sleeve surrounding said upturned end of said bar extends normal to the axis of said conductor.

7. A lug assembly as set forth in claim 6 wherein the width perpendicular to said conductor of that portion of said weld sleeve surrounding said upturned end of said bar is approximately the same width as said one end of said bar and wider than that portion of said weld sleeve surrounding said conductor.

* * * * *